US007066674B2

(12) United States Patent
Gueret

(10) Patent No.: US 7,066,674 B2
(45) Date of Patent: Jun. 27, 2006

(54) APPLICATION DEVICE, SYSTEM, AND METHOD

(75) Inventor: Jean-Louis H. Gueret, Paris (FR)

(73) Assignee: L'Oreal, S.A., Paris (FR)

( * ) Notice: Subject to any disclaimer, the term of this patent is extended or adjusted under 35 U.S.C. 154(b) by 0 days.

(21) Appl. No.: 09/981,184

(22) Filed: Oct. 18, 2001

(65) Prior Publication Data

US 2002/0057938 A1 May 16, 2002

(30) Foreign Application Priority Data

Nov. 7, 2000 (FR) ..... 00 14288

(51) Int. Cl.
*A46B 11/00* (2006.01)

(52) U.S. Cl. ..... 401/125

(58) Field of Classification Search ..... 401/123–127, 401/128–130, 118, 119, 120
See application file for complete search history.

(56) References Cited

U.S. PATENT DOCUMENTS

| | | | | |
|---|---|---|---|---|
| 813,813 | A * | 2/1906 | Munroe | 401/129 |
| 882,668 | A * | 3/1908 | Davis | 132/290 |
| 1,534,259 | A * | 4/1925 | Dempsey | 401/130 |
| 1,573,036 | A * | 2/1926 | Bowman | 401/130 |
| 1,580,690 | A * | 4/1926 | Sierad et al. | 401/130 |
| 1,641,765 | A * | 9/1927 | Krank | 401/130 |
| 1,818,340 | A * | 8/1931 | Lemoine | 401/130 |
| 2,122,350 | A * | 6/1938 | Mitchell | 132/293 |
| 2,311,367 | A * | 2/1943 | Chambers | 401/119 |
| 2,480,331 | A * | 8/1949 | Lecker | 401/125 |
| 2,554,302 | A * | 5/1951 | Keskitalo | 222/187 |
| 2,554,489 | A | 5/1951 | Crane | |
| 2,716,250 | A | 8/1955 | Deakers | |
| 2,767,417 | A | 10/1956 | Amen | |
| 2,807,816 | A | 10/1957 | O'Brien | |
| 3,132,653 | A | 5/1964 | Gazdik | |
| 3,209,769 | A | 10/1965 | Gobin | |

(Continued)

FOREIGN PATENT DOCUMENTS

CA 1 288 391 9/1991

(Continued)

OTHER PUBLICATIONS

English language translation of French Patent No. 2 588 457, Apr. 17, 1987.

(Continued)

*Primary Examiner*—Justine R. Yu
*Assistant Examiner*—Huyen Le
(74) *Attorney, Agent, or Firm*—Finnegan Henderson Farabow Garrett & Dunner, L.L.P.

(57) ABSTRACT

A device for applying at least one product comprising at least one receptacle configured to contain a product and a removable unit defining a substantially enclosed space. The removable unit may be configured to be removably positioned on the at least one receptacle. The device further may comprise at least one application element configured to be housed within the substantially enclosed space defined by the removable unit when the application element is not in use for applying product and may be configured to be loaded with product from the receptacle when the removable unit is positioned on the receptacle. The application element also may comprise at least one surface configured to apply the loaded product, the at least one surface facing the receptacle when the removable unit is positioned on the receptacle during loading of the application element with the product.

159 Claims, 10 Drawing Sheets

U.S. PATENT DOCUMENTS

| | | | | |
|---|---|---|---|---|
| 3,266,079 | A | 8/1966 | Schwartzman | |
| 3,345,673 | A | 10/1967 | Schwartzman | |
| 3,390,940 | A | 7/1968 | Schwartzman | |
| 3,540,448 | A | 11/1970 | Sunnen | |
| 3,862,806 | A * | 1/1975 | Brown | 401/118 |
| 3,871,390 | A | 3/1975 | Spatz | |
| 4,089,609 | A | 5/1978 | Gring et al. | |
| 4,752,147 | A * | 6/1988 | Persi | 401/126 |
| 4,795,063 | A | 1/1989 | Sekiguchi et al. | |
| 4,974,981 | A * | 12/1990 | Bennett | 401/123 |
| 5,002,415 | A | 3/1991 | Gueret | |
| 5,052,592 | A | 10/1991 | Wilken et al. | |
| 5,088,849 | A | 2/1992 | Johnson et al. | |
| 5,096,319 | A | 3/1992 | Gueret | |
| 5,178,300 | A | 1/1993 | Haviv et al. | |
| 5,188,472 | A * | 2/1993 | Sgro | 401/124 |
| 5,324,127 | A | 6/1994 | Cortez | |
| 5,492,426 | A | 2/1996 | Gueret | |
| 5,636,931 | A | 6/1997 | Gueret | |
| 5,692,846 | A | 12/1997 | Schwarzberg | |
| 5,865,194 | A | 2/1999 | Gueret | |
| 5,890,828 | A | 4/1999 | Gueret | |
| 5,945,076 | A | 8/1999 | Leonard et al. | |
| 6,309,124 | B1 * | 10/2001 | Gueret | 401/124 |
| 6,447,191 | B1 | 9/2002 | Vasas | |

FOREIGN PATENT DOCUMENTS

| | | |
|---|---|---|
| CH | 339 231 | 6/1959 |
| CH | 406 544 | 1/1996 |
| DE | 938 658 | 1/1956 |
| DE | 406 544 | 8/1966 |
| DE | 2 157 620 | 5/1973 |
| DE | 39 38 347 | 5/1991 |
| EP | 0 263 329 | 4/1988 |
| EP | 0 374 339 | 6/1990 |
| EP | 0 380 183 | 8/1990 |
| EP | 0 612 488 | 8/1994 |
| EP | 0 688 516 | 12/1995 |
| EP | 0 743 263 | 11/1996 |
| EP | 1 020 135 | 7/2000 |
| EP | 1 029 799 | 8/2000 |
| EP | 1 044 625 | 10/2000 |
| FR | 1 461 630 | 2/1967 |
| FR | 2 502 472 | 10/1982 |
| FR | 2 588 457 | 4/1987 |
| FR | 2 633 498 | 1/1990 |
| FR | 2 744 602 | 8/1997 |
| FR | 2 750 406 | 1/1998 |
| FR | 2 754 458 | 4/1998 |
| FR | 2 792 296 | 10/2000 |
| GB | 838 800 | 6/1960 |
| GB | 1 105 590 | 3/1968 |
| GB | 1 311 086 | 3/1973 |
| GB | 2 084 455 | 4/1982 |
| GB | 2 137 181 | 10/1984 |
| JP | 32-1573 | 3/1957 |
| JP | 40-1103 | 1/1965 |
| JP | 44-14946 | 6/1969 |
| JP | 60-157674 | 10/1985 |
| JP | 61-134712 | 8/1986 |
| JP | 2-138620 | 11/1990 |
| JP | 4-23688 | 2/1992 |
| JP | 6-284925 | 10/1994 |
| JP | 3031090 | 8/1996 |
| JP | 3051963 | 6/1998 |
| JP | 10-507399 | 7/1998 |
| JP | 2000-166644 | 6/2000 |
| WO | WO 91/12197 | 8/1991 |
| WO | WO 99/38561 | 8/1999 |

OTHER PUBLICATIONS

English language translation of Germany Patent No. 938 658, Jan. 5, 1956.
Co-pending U.S. Appl. No. 09/482,685, filed Jan. 14, 2000, Title: Device for Dispensing and Applying a Product, Inventor(s): Jean-Louis H. Gueret.
Co-pending U.S. Appl. No. 09/550,588, filed Apr. 17, 2000, Title: Applicator and Applicator Assembly Equipped With such an Applicator, Inventor(s): Jean-Louis H. Gueret.
English language translation of CH 406 544.
English language Derwent Abstract of DE 39 38 347, May 23, 1991.
English language Derwent Abstract of EP 0 743 263, Nov. 20, 1996.
English language Derwent Abstract of EP 1 020 135, Jul. 19, 2000.
English language Derwent Abstract of EP 1 044 625, Oct. 18, 2000.
English language Derwent Abstract of FR 2 502 472, Oct. 1, 1982.
English language Derwent Abstract of FR 2 750 406, Jan. 2, 1998.
English language Derwent Abstract of FR 2 792 296, Oct. 20, 2000.
English language Abstract of EP 1 029 799, Aug. 23, 2000.
English language Translation of DE 406 544, Aug. 15, 1966.
English language Translation of JP 44-14946, Jun. 26, 19.
English language Translation of JP 4-23688, Feb. 26, 1992.
English language Translation of JP 60-157674, Oct. 21, 1985.
English language Translation of JP 40-1103, Jan. 13, 1965.
English language Translation of JP 2-138620, Nov. 20, 1990.
English language Translation of JP 3051963, Jun. 24, 1998.
Co-pending U.S. Appl. No. 09/986,021; Title: Product Application Device Including a Dip Tube Inventor: Jean-Louis H. Gueret Filed: Nov. 7, 2001.
Office communication dated Oct. 15, 2002 from U.S. Patent and Trademark Office in Co-pending U.S. Appl. No. 09/986,021.
Response to Office communication dated Oct. 15, 2002, in Co-pending U.S. Appl. No. 09/986,021, filed Nov. 1, 2002.
Office communication dated Jan. 15, 2003 from U.S. Patent and Trademark Office in Co-pending U.S. Appl. No. 09/986,021.
Response to office communication dated Jan. 15, 2003, in Co-pending U.S. Appl. No. 09/986,021, filed on Jul. 14, 2003.
Office communication dated Oct. 3, 2003 from U.S. Patent and Trademark Office in Co-pending U.S. Appl. No. 09/986,021.
Notice of Allowance dated Feb. 4, 2004 from U.S. Patent and Trademark Office in Co-pending U.S. Appl. No. 09/986,021.

* cited by examiner

APPLICATION DEVICE, SYSTEM, AND METHOD

The present invention relates to an application device, and related methods, for dispensing and/or applying a product, such as a cosmetic product or a care product, for example. In particular, the invention relates to a device and related methods for dispensing and/or applying perfumes.

In the past, perfumes have been contained in glass flasks with a neck portion closed by ground-glass stoppers that may be used to dab a drop of perfume on a region of the body, for example, on the neck or the wrists. Perfumes also have been contained in aerosol flasks or in flasks fitted with a pump-like dispenser. In general, such flasks are relatively large in size and may be somewhat inconvenient to carry around.

Moreover, spraying may result in relatively inaccurate placement of the product and often may lead to the perfuming of clothing at the same time as the body.

A need exists for a device that may remedy at least one of the above-mentioned drawbacks, and that also may be relatively compact and/or enable application to be performed relatively accurately. A need also exists for a way of applying a product, such as a cosmetic product or a care product, for example, that may provide a feeling of freshness upon application to a surface, such as a region of the body, the hair, fingernails, or toenails, for example.

Further, it may be desirable to provide a device for applying a product that can be filled, and refilled, with product, and that can be carried for a period of time substantially without the product filled therein evaporating. Such a device may be relatively compact and be configured to be filled with product via a larger receptacle containing a reserve of product. Once filled, the device may be removed from the receptacle to be carried by the user for later use of the filled product, substantially without risk of the product leaking from the filed device and/or evaporating.

It should be understood that the invention could be practiced without performing one or more of the preferred objects and/or advantages described above. Other objects of the invention will become apparent from the detailed description which follows.

As embodied and broadly described herein, one aspect of the invention includes a device for applying at least one product, the device comprising at least one receptacle configured to contain a product and a removable unit defining a substantially enclosed space. The removable unit may be configured to be removably positioned on the at least one receptacle. The device may further comprise at least one application element configured to be housed within the substantially enclosed space defined by the removable unit when the application element is not in use for applying product. The application element may be configured to be loaded with product from the receptacle when the removable unit is positioned on the receptacle.

The term "substantially enclosed" as used herein refers to an embodiment of a removable unit defining a space that is configured so as to substantially prevent leakage from the removable unit of product that has been loaded into the application element. The term also encompasses an embodiment of a removable unit configured so as to substantially limit evaporation of the product loaded into the removable unit so that the application element may continue to remain loaded with product and for a period of time be useful for applying the product at a later time, for example, at least several hours after the removable unit has been filled with product. The substantially enclosed space defined by the removable unit therefore may be substantially hermetically sealed from the exterior of the unit. For example, such a substantially enclosed space may be included in a removable unit defining a completely enclosed space and/or a removable unit having an orifice plugged with a valve or other similar closure mechanism providing selective flow communication with the space.

A removable unit having a relatively small, unplugged orifice or other opening communicating with the space also falls within the scope of a removable unit defining a substantially enclosed space. In this case, the orifice (or opening) is sized so as to substantially limit evaporation of the product loaded into the removable unit and/or to substantially prevent leakage of the product from the orifice. The size of the orifice will depend on various factors, such as the nature of the loaded product, for example, its rate of evaporation, the size of the space defined by the removable unit, and the length of time after loading that it may be desirable to use the product, for example, several hours.

The application element also may comprise at least one surface configured to apply the loaded product, the at least one surface facing the receptacle when the removable unit is positioned on the receptacle during loading of the application element with the product.

By way of example, the at least one application surface facing the receptacle may present the advantage that a relatively small quantity of substance coming from the receptacle can suffice to load the application element. This is because the product coming from the receptacle may reach the application surface without traveling along a long path or being absorbed by an intermediate substance-absorbing material. In another aspect of the invention, the application element presents a surface for applying the product, wherein the surface faces a wall that is impermeable to the product.

Facing the application surface toward the receptacle and/or an impermeable wall also may permit a quantity of product brought to the application surface to remain in contact therewith or be reabsorbed by the application element.

Yet another aspect includes a device for applying a product, the device comprising a removable unit defining a substantially enclosed space and being configured to be removably positioned on a receptacle containing a product. The removable unit may comprise a first portion configured to removably engage with a portion of the receptacle. The removable unit may further comprise a second portion configured to cooperate with the first portion so as to place the removable unit in one of a closed position so as to substantially restrict access to the space and an open position so as to permit access to the space. The device may also comprise at least one application element configured to be received in the substantially enclosed space when the application element is not in use for applying product. The at least one application element may be one of secured to the second portion and separated from the first portion and the second portion. The first portion and the second portion may be configured to be separated from one another when the removable unit is in the open position.

According to an exemplary embodiment, at least a portion of the at least one application element may be porous and may be configured to hold a reserve of product.

The removable unit may comprise a first portion and second portion that are removably engageable with one another. The first portion and second portion may be removably engageable by screw fastening or snap-fastening, for example, or by any other similar suitable mechanism. The second portion may be hingedly connected to the first portion. The first portion and second portion may be engageable in a substantially leakproof manner. According to an exemplary embodiment, at least one of the first portion and the second portion may include a sealing member. The sealing member may be chosen from a sealing skirt and a sealing gasket configured to press in a substantially leakproof manner against at least the other of the first and second portion.

In an exemplary embodiment, the at least one application element may be secured to one of the first portion and the second portion. The portion to which the at least one application element is secured may be configured as a handle member configured to be held during application of the product. Moreover, the portion to which the at least one application element is secured may define an orifice configured to permit flow of product therethrough for loading the at least one application element when the removable unit is positioned on the receptacle.

The at least one application element may be configured to be separated from the first and second portions during application of the product. The device may further comprise a handle member configured to be held during application of product via the application element. The at least one application element may comprises a portion forming the handle member. The portion forming the handle member may be configured to be compressed when the first portion and the second portion are engaged with one another and to expand when the first portion and the second portion are removed from one another.

According to yet another optional embodiment, the removable unit may comprise an endpiece configured to cooperate with a portion of the receptacle. The endpiece may be configured to cooperate with one of a valve, a pump, and a neck portion associated with the receptacle. The endpiece may be configured to cooperate with one of a valve and a pump on the receptacle and the removable unit may be configured to move relative to the receptacle so as to actuate said one of the pump and the valve.

The receptacle may define an orifice for flowing product into the removable unit when the removable unit is positioned on the receptacle, and the device may further comprise a sealing member configured to establish a substantially leakproof connection between the removable unit and the orifice.

According to an exemplary embodiment, the removable unit may further comprise a valve configured to open to permit an amount of product to flow from the receptacle into the removable unit while the removable unit is positioned on the receptacle. The valve may further be configured to close at least when the removable unit is removed from the receptacle. The removable unit may comprise a first portion and a second portion configured to be removably engaged with one another, and the valve may be one of overmolded and fixed by snap fastening on one of the first and second portions.

The removable unit may comprise a wall defining at least one orifice configured to flow product therethrough. The wall may define a bottom of the space containing the at least one application element when the removable unit is positioned on the receptacle. The device may further comprise a pad configured to be disposed between the at least one application element and the orifice when the removable unit is positioned on the receptacle. The pad optionally may be porous.

The at least one application element may be made of a non-compressible material. As an example, the application element may be made of a sintered material. The application element may be made of a material chosen from sintered polyethylene, PVC, EVA, polyamide, and brass. The at least one application element may be made of a compressible material. For example, the application element may be made of an elastically deformable material. Further, the application element may be made of a material chosen from a foam of polyurethane, a foam of polyester, a foam of polyether, a foam of PVC, a foam of NBR, a felt, and a multilayer composite. According to an exemplary embodiment, at least part of the at least one application element may be one of flocked, comprise a woven surface fabric, and comprise a non-woven surface fabric.

According to yet another embodiment, the device may further comprise a housing associated with the receptacle and being configured to receive at least part of the removable unit. The housing may comprise a wall for guiding movement of the removable unit while it is placed in position on the receptacle. The housing may include at least one relief portion for cooperating with the removable unit so as to substantially prevent rotation of the removable unit relative to the receptacle when the removable unit is positioned on the receptacle.

The device also may comprise one of a pump and a valve for dispensing product from the receptacle into the removable unit. The one of the pump and the valve may be configured to be actuated by the removable unit.

The receptacle may define an orifice configured to be in flow communication with the product in the receptacle. The device may further comprise a cock configured to substantially prevent flow communication from outside the receptacle through the orifice when the removable unit is removed from the receptacle.

The receptacle may comprise a housing for receiving the removable unit, the housing being provided with a lid configured to close the housing when the removable unit is removed from the receptacle. The lid may be hingedly connected to the receptacle.

In yet another embodiment of the invention, the receptacle comprises a dispensing member on a portion of the receptacle separate from a portion on which the removable unit is configured to be positioned, the dispensing member being configured to dispense product from the receptacle. The dispensing member may be a pushbutton actuator, for example, or other similar suitable actuation mechanism, such as a valve. The dispensing mechanism may be positioned on the same side of the receptacle as the removable unit. For example, the dispensing mechanism and the removable unit may be positioned on a top portion of the receptacle. Alternatively, the dispensing mechanism may be positioned on a different side of the receptacle than the removable unit. For example, the dispensing mechanism and the removable unit may be positioned on substantially opposite sides of the receptacle. The dispensing mechanism and the removable unit may be positioned substantially along a longitudinal axis of the receptacle.

The dispensing mechanism may be configured to dispense product from the receptacle independent from loading of the at least one application element with the product.

The device, according to an exemplary embodiment of the invention, may comprise a dip tube configured to extend within the receptacle.

The at least one application element may occupy a portion of the space when the product is not loaded therein and be configured to expand within the space upon being loaded with product.

The removable unit may be configured to be placed in a closed position in which access to the space is substantially prevented and an open position in which access to the space is permitted. The at least one application element may be configured to be compressed when the removable unit is in the closed position and to expand when the removable unit is in the open position. A portion of the application element may form a handle member upon expansion.

The removable element may further comprise a hinged lid portion, the at least one application element being attached to the hinged lid portion.

In an exemplary embodiment, the receptacle may comprise a housing configured to receive the removable unit and a removable dispensing mechanism for dispensing product from the receptacle. The device may further comprise the dispensing mechanism and the dispensing mechanism may comprise a push-button actuator, for example.

Yet another aspect includes a device for applying at least one product comprising a removable unit defining a substantially enclosed space and being configured to be removably positioned on a receptacle containing a product. The device may further comprise at least one application element configured to be received within the substantially enclosed space, the at least one application element being further configured to be loaded with product from the receptacle when the removable unit is positioned on the receptacle. The at least one application element may comprise at least one surface configured to apply the loaded product. The at least one surface may face the receptacle when the removable unit is positioned on the receptacle during loading of the at least one application element with product.

According to yet another exemplary embodiment, the invention includes an application system comprising a device and at least two receptacles on which the removable unit is configured to be independently removably positioned. The at least two receptacles may be either held by a common support or housed in a common box. Further, each of the at least two receptacles may contain product differing from product contained in another of the at least two receptacles.

In yet another aspect, the invention may include a method of loading an application device, comprising providing a removable unit defining a space and at least one application element configured to be received within the space. The method may further comprise selecting at least one receptacle from a plurality of receptacles containing differing products and positioning the removable unit on the at least one selected receptacle. The method also may include flowing product from the at least one selected receptacle into the removable unit so as to load the at least one application element with the product from the at least one selected receptacle.

The term "providing," as used herein, may broadly refer to, but is not limited to, making available for use, giving, supplying, obtaining, getting a hold of, acquiring, purchasing, selling, distributing, possessing, making ready for use, and/or placing in a position ready for use.

The method may further comprise placing the at least one loaded application element in contact with a surface so as to apply the loaded product to the surface.

The method also may comprise removing the removable unit from the selected receptacle after loading the at least one application element with the amount of product and carrying the removable unit away from the receptacle.

According to another aspect, the method may comprise opening the removable unit so as to permit access to the at least one surface of the application element configured for applying the loaded product.

The selecting may comprise selecting more than one receptacle from the plurality of receptacles containing differing products.

The method also may comprise positioning the removable unit on each of the selected receptacles one at a time and flowing product from each of the selected receptacles into the removable unit when the removable unit is positioned on the respective selected receptacle. The method may further comprise placing the at least one application element loaded with product flowed from one of the selected plurality of receptacles into contact with a surface so as to apply the loaded product to the surface prior to positioning the removable unit on another of the selected receptacles and flowing the product from the other selected receptacle into the removable unit.

The plurality of receptacles may contain products having differing scents. At least one of the plurality of receptacles may contain an active agent.

In yet another aspect, a method of loading an application device with product comprises providing a removable unit defining a space and at least one application element configured to be received within the space and providing at least a first receptacle containing a first product and a second receptacle containing a second product. The method further may comprise positioning the removable unit on the first receptacle and flowing the first product from the first receptacle into the removable unit so as to load the at least one application element with the first product. Also, the method may comprise positioning the removable unit on the second receptacle and flowing the second product from the second receptacle into the removable unit so as to load the at least one application element with the second product.

The flowing of the second product into the removable unit may include flowing the second product into the removable element when the at least one application element is loaded with the first product.

The first product may be a perfume having a first scent and the second product may be a perfume having a second scent differing from the first scent.

As an option, the method may further comprise applying the first product loaded onto the application element prior to the positioning of the removable unit on the second receptacle.

According to yet another aspect, the invention includes a method of loading an application device, comprising providing a device and selecting at least one receptacle from a plurality of receptacles containing differing products. The method may further comprise positioning the removable unit on the at least one selected receptacle and flowing product from the at least one selected receptacle into the removable unit so as to load the at least one application element with at least the product from the at least one selected receptacle.

Yet another aspect includes a device for applying a product comprising a housing defining a space and being configured to be removably positioned on a receptacle containing a product to be applied. The device may further comprise at least one compressible element configured to be received in the space and to be loaded with product from the receptacle when the housing is positioned on the receptacle and an actuator configured to move relative to the housing and to compress the compressible element within the space so as to release loaded product from the compressible element. The device also may comprise a passage in flow communication with an exterior of the housing, the passage being configured to permit flow of product released from the compressible element.

The actuator may comprises a push-button and also may define the passage.

The housing may comprise a transverse wall configured to engage with a portion of the receptacle. The transverse wall may define an orifice configured to flow the amount of product from the receptacle to the compressible element when the housing is positioned on the receptacle.

The actuator may be configured to slide within the housing, for example, the actuator may sealably slide within the housing.

The device may comprise an air passage permitting flow communication between the space and an exterior of the housing so as to permit residual air pressure to be released from the space. A valve may be configured to close the orifice at least when the housing is removed from the receptacle.

The compressible element may be made of an elastically deformable open-celled foam.

Yet another aspect includes a method of loading an application device, comprising providing a device and selecting at least one receptacle from a plurality of receptacles containing differing products. The method may further include positioning the housing on the at least one selected receptacle and flowing product from the at least one selected receptacle into the housing unit so as to load the at least one compressible element with at least the product from the at least one selected receptacle.

The method may comprise compressing the at least one loaded compressible element so as to flow the loaded product from the passage.

Further, the method may include removing the housing from the selected receptacle after loading the at least one compressible element with the product and carrying the housing away from the receptacle.

The selecting may comprise selecting more than one receptacle from the plurality of receptacles containing differing products and the method may further comprise positioning the housing on each of the selected receptacles one at a time and flowing product from each of the selected receptacles into the removable unit.

The plurality of receptacles may contain products having differing scents.

The application element also may be non-porous and, for example, it could include one or more surface reliefs, for example, stripes, cavities, furrows, or the like, which may enable the product to be better absorbed.

The removable element can be compact, for example, since it can be of dimensions suitable for taking only just enough product for application during a single day.

Thus, a woman may keep the receptacle or receptacles in a fixed location, for example, in a bathroom, or the like, and can take the removable unit away daily in her handbag after refilling it.

The application element may be arranged so as to serve merely as a holder of the product, being suitable for releasing the product when it is compressed, for example.

In an exemplary embodiment, the application element may give the user a feeling of freshness and softness, for example.

In addition, the device, system, and method of the invention may permit the product to be applied accurately since it can be transferred by contact between the application element and the surface, such as the skin, the fingernails, the toenails, or the hair, for example.

As mentioned above, the receptacle can include a pump or a valve for dispensing the product into the removable unit and the pump or valve advantageously may be actuated by the removable unit.

It also may be possible for the receptacle not to include a pump or a valve but to include merely a dispenser orifice that communicates directly with the supply of substance in the receptacle.

In a variant, instead of using a cock, the receptacle may be provided with a lid, for example, suitable, in the absence of the removable unit, for closing the receptacle so as to substantially prevent evaporation of product inside the receptacle. Such a lid can be hinged to the neck of the receptacle, for example.

Product may be dispensed by mechanical action causing the inside volume of the receptacle to be decreased, for example, by compressing the wall of the receptacle assuming the wall is flexible.

The inside space of the removable unit can, for example, may be either smaller than, substantially equal to, or greater than the application element.

The invention may also include, in an exemplary embodiment, a receptacle including a housing suitable for receiving a removable unit or a pushbutton enabling a spray to be dispensed, the removable unit and the pushbutton being interchangeable in the housing.

In an exemplary embodiment, the product in the receptacle includes a cosmetic product or care product, such as a perfume or a perfumed cream or gel, for example. The product in an exemplary embodiment may be liquid or semi-liquid.

By way of example, a plurality of receptacles may all be accessible while the removable unit is being filled with one of the products, and the user may select from the plurality of receptacles as a function of the products the user desires to introduce into the removable unit.

In a variant, the receptacle may contain various different active agents, for example, that a user might desire to add to a product for application to the skin, for example.

Besides the structural and procedural arrangements set forth above, the invention could include a number of other arrangements, such as those explained hereinafter. It is to be understood that both the foregoing description and the following description are exemplary.

The accompanying drawings are included to provide a further understanding of the invention and are incorporated in and constitute a part of this specification. The drawings illustrate exemplary embodiments of the invention and, together with the description, serve to explain certain principles. In the drawings, FIG. 1 is a partial perspective view of an embodiment of a device according to the present invention;

Figure 1:
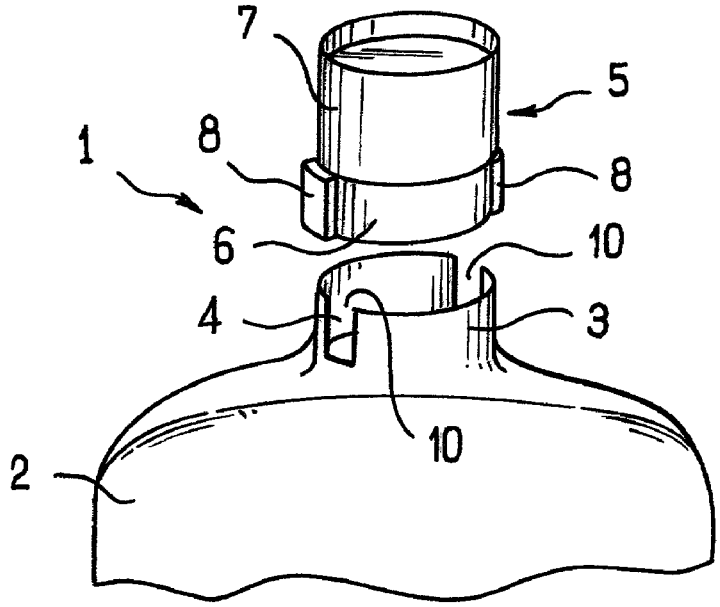

Reference will now be made in detail to exemplary embodiments of the invention, examples of which are illustrated in the accompanying drawings. Wherever possible, the same reference numbers are used in the drawings and the description to refer to the same or like parts, and the same reference numbers with alphabetical suffixes are used to refer to similar parts.

FIG. 1 shows a device for dispensing and applying a product according to a first exemplary embodiment of the invention. The device 1 comprises a receptacle 2 having a neck portion 3. The neck portion 3 defines a housing 4 for receiving a removable unit 5.

The removable unit 5 comprises a bottom portion 6 and a top portion 7 that may be assembled together as shown. For example, portions 6 and 7 may be assembled together by screw fastening, as shown. Other suitable means for fastening the portions 6 and 7 together also may be used, such as, snap-fastening, for example.

The bottom portion 6 may have two substantially diametrically-opposite studs 8. The studs 8 may cooperate with two relief portions, for example, notches 10, formed in the neck portion 3 so as to prevent the bottom portion 6 from rotating relative to the neck portion 3. This may enable the top portion 7 to be unscrewed while the removable unit 5 remains substantially in place on the receptacle 2.

Figure 2:
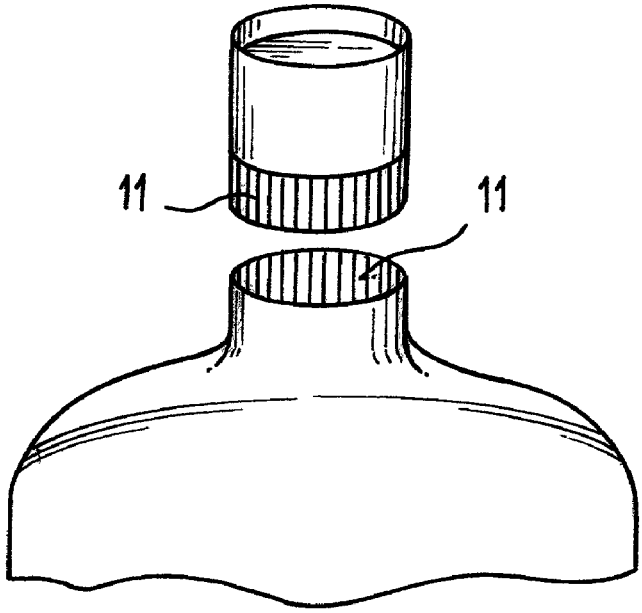
FIG. 2 is a partial perspective view of another embodiment of a device according to the present invention.

It should be noted that the invention is not limited to one particular type of relief. By way of example, FIG. 2 shows a removable unit and a receptacle in which the relief is formed by fluting 11. Other types of reliefs also are envisioned as being within the scope of the invention.

Figure 3:
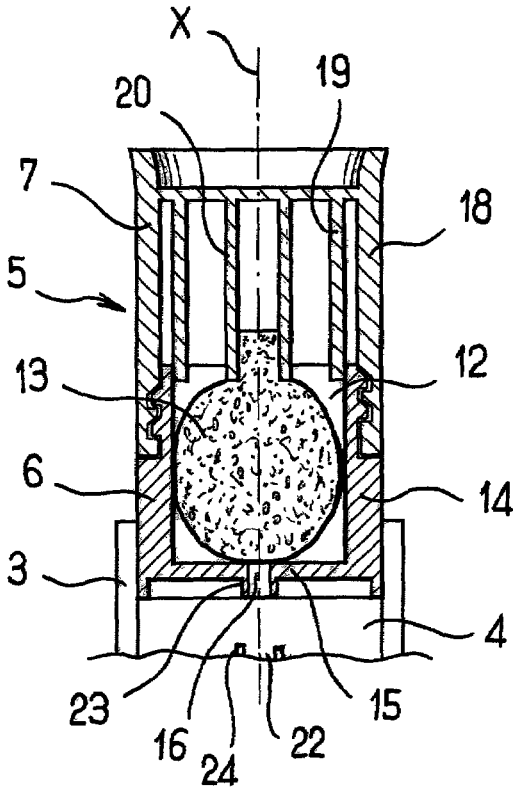
FIG. 3 is a partial cross-sectional view of the removable unit of the device of FIG. 1.

FIG. 3 shows an axial cross-section of the removable unit 5 and the top portion of the neck portion 3 of the receptacle 2. The removable unit 5 defines an inside space 12 configured to house an application element 13. The application element 13 may be in the form of a porous member, for example.

In the example shown, a bottom portion 6 of the removable unit 5 comprises a substantially tubular wall 14 having a longitudinal axis X. The tubular wall 14 has a threaded portion at a top end thereof and is closed at the bottom end by a traverse wall 15. The transverse wall 15 extends substantially perpendicularly to the axis X. The wall 15 may be pierced in its center by an orifice 16.

The orifice 16 has an opening facing the porous element 13 and an opening facing the receptacle 2. The orifice 16 may thereby place the product in the receptacle in flow communication with the space 12 and the application element 13. The orifice 16 is sized so as to permit flow of the product from the receptacle 2 into the removable unit 5 when sufficient pressure is exerted on the product in the receptacle 2, for example, via a suction force or a positive pressure, such as a pumping force.

To provide a sealed assembly of the bottom and top portions 6 and 7, the top portion 7 can, for example, comprise an outer skirt 18 with an inside thread suitable for screwing onto the tubular wall 14. A sealing skirt 19 suitable for pressing in leakproof manner against the radially inner surface of the tubular wall 14 when the removable unit 5 is closed may also be provided, as shown in FIG. 3.

The top portion 7 also defines a central chimney 20 configured to hold the element 13.

The neck portion 3 may include a dispenser orifice 22 defined by a wall 24. The dispenser orifice 22 may open out into the bottom of the housing 4.

On the outside face of the transverse wall 15, the removable unit 5 may include an annular sealing lip 23. The sealing lip 23 may cooperate with the wall 24 so as to establish substantially leakproof communication between the orifices 16 and 22 when the removable unit 5 is pushed fully into the housing 4 of the receptacle 2.

The orifice 22 may be fed with product taken from inside the receptacle 2 in a variety of ways. For example, an aerosol type valve, a pump, a cock, or a dip tube, or other similar suitable mechanisms may be used.

It will be observed that the cross-section of the orifice 16 may be relatively small such that the inside space 12 is substantially enclosed. That is, the space 12 may be sufficiently hermetic to ensure that the product contained in the element 13 may be conserved for a length of time sufficient to enable the removable unit 5 to be useful for applying product for a time period after it has been removed from the receptacle 2.

Thus, the cross-section of the orifice 16 may be small enough such that the product contained in the element 13 evaporates at a speed that may ensure that a substantial quantity of product is conserved within the element 13 for a duration of several hours, for example, while the removable unit is being carried about in a handbag or the like, for example. Also, the orifice 16 may be sized so as to substantially prevent leakage of product from the removable unit 5.

For example, the greater the volatility of the product impregnating the element 13, the smaller the cross-section of the orifice 16, in the absence of any check valve or other closure mechanism.

The element 13 may be either compressible or incompressible. By way of example, the element 13 may be formed as an open-celled foam, such as a foam of polyurethane, polyester, polyether, PVC, NBR, or other suitable materials, for example. The element 13 also may be formed as a sintered element, such as sintered polyethylene, PVC, EVA, polyamide, brass, or other similar materials, for example.

The element 13 also may be formed as a felt or by a flocked elastomer, in which case its porosity may not extend to the core of the element 13 but instead remain substantially near the surface.

The application element 13 may be suitable for retaining the substance, such as by capillarity, for example, or other absorption or retention mechanism.

The device 1 shown in FIG. 1 may be used as follows.

The removable unit 5 may be put into place on the receptacle 2, with the orifices 16 and 22 being brought into leakproof communication with each other, as described above.

A quantity of product may be dispensed through the orifice 22 by actuating a pump or other suitable mechanism so as to pass the product through the orifice 16 and into the space 12. The product passed into the space 12 may impregnate the application element 13, at least on the surface, for example. It will be observed that the orifice 16 through which the product flows may open substantially directly in contact with at least one region 13*a* of the surface of the applicator element 13 that may be used for applying the substance. A small quantity of product taken from the receptacle 2 may thus suffice to enable the removable unit 5 to be used in a satisfactory manner at a later time.

To apply the product, the top portion 7 may be unscrewed while the bottom portion 6 remains in place on the receptacle 2. In this way, the top portion 7 may serve as a handle member. In another operation mode, the removable unit 5 may be withdrawn completely from the receptacle 2 and used separately from the receptacle 2. The removable unit 5 loaded with product may be capable of being used for applying the product over a period of a few hours, for example, after it has been loaded and removed from the receptacle 2.

To apply the product, the user may remove the top portion 7 from the bottom portion 6, and use it as a handle member.

The removable unit 5 may periodically be put back into place on the receptacle 2 in order to refill the element 13 with product.

The removable unit 5 may be compact and relatively easily carried in a bag, or the like, with the receptacle 2 remaining in another location, such as on a shelf in a bathroom, for example.

Naturally, the invention is not limited to the example described above.

Various non-limiting variants of a device for dispensing and applying a product are described below.

Figure 4:
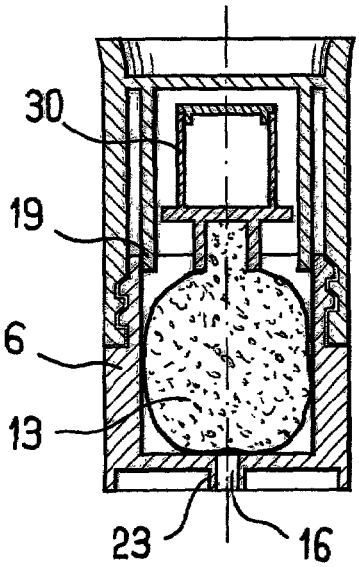
FIG. 4 is a cross-sectional view of an embodiment of a removable unit.

In the variant shown in FIG. 4, the element 13 may no longer be secured to the top portion of the removable unit 5 and the central chimney 20 may be omitted. The element 13 instead may be secured to an independent handle member 30, which may be made of rigid plastic material, for example.

Figure 21:
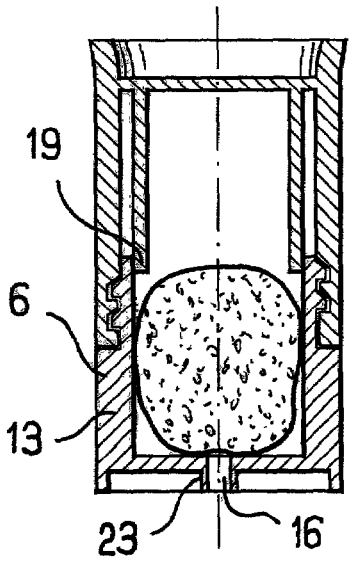
FIG. 21 is a view analogous to FIG. 4, showing yet another embodiment of a refillable element.

This handle member 30 also may be omitted, as shown in FIG. 21, for example.

Figure 5:
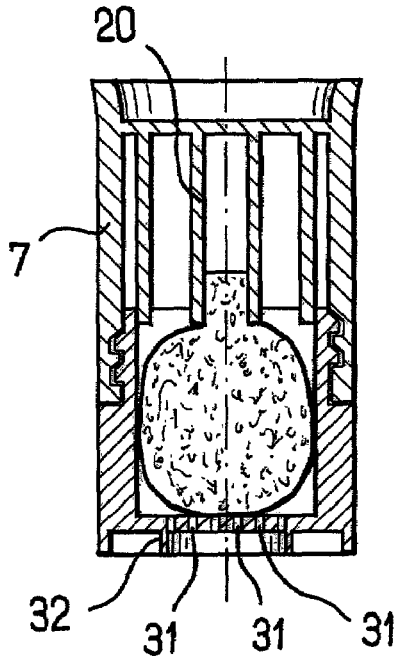
FIG. 5 is a cross-sectional view of another embodiment of a removable unit.

As shown in FIG. 5, the orifice 16 may be replaced by a plurality of orifices 31. The annular sealing lip 23 also may be replaced by a sealing lip 32 of greater diameter.

Figure 6:
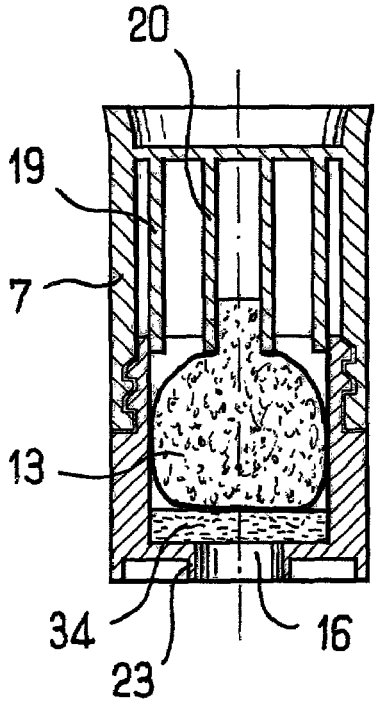
FIG. 6 is a cross-sectional view of another embodiment of a removable unit.

FIG. 6 shows an embodiment wherein the bottom of the housing 12 receiving the element 13 is provided with a porous pad 34, which may be in the form of a disk of open-celled foam or by a felt disk or by a sintered element, or the like, for example. Where appropriate, the pad 34 may make it possible to have an orifice 16 of larger diameter than that shown in FIG. 3. This is because evaporation of the product contained in the element 13 may be hindered by the pad 34.

The pad 34 also may contain a supply of substance. This may increase the amount of product that can be carried by the removable unit 5.

Figure 7:
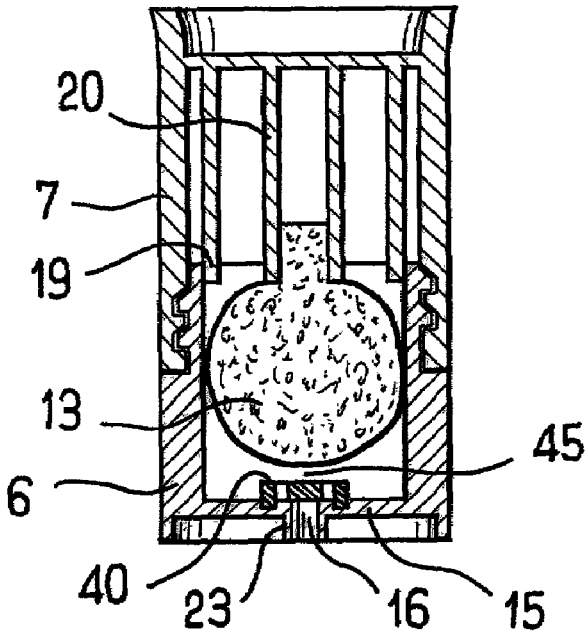
FIG. 7 is a cross-sectional view of yet another embodiment of a removable unit.

The exemplary embodiment shown in FIG. 7 differs from that shown in FIG. 3 at least in that the removable unit 5 includes a check valve that closes the orifice 16 and opens in response to pressure from the product coming from the receptacle 2 when the removable unit 5 is in place on the receptacle 2 and is being filled with product.

Figure 8:
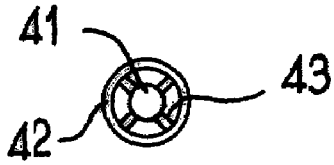
FIG. 8 is a plan view of an embodiment of the check valve of the removable unit of FIG. 7.

As can be seen more clearly in FIG. 8, the check valve 40 may comprise a central valve member 41. The valve member 41 may have a diameter greater than the diameter of the orifice 16, and a peripheral portion 42 for fixing to the transverse wall 15. The valve member 41 also may connect to the peripheral portion 42 via bridges of material 43 that may be sufficiently flexible and deformable to enable the valve member 41 to move away from the traverse wall 15 under pressure from the product while the removable unit 5 is being refilled.

As shown in FIG. 7, the element 13 may leave a gap 45 above the check valve 40 so as to avoid hindering operation thereof.

As in the example described, the check valve 40 may be overmolded on the bottom portion 6 of the removable unit 5, for example.

It would not go beyond the scope of the present invention for the check valve to be made in some other way, such as in the form of one or more attachments.

Figure 9:
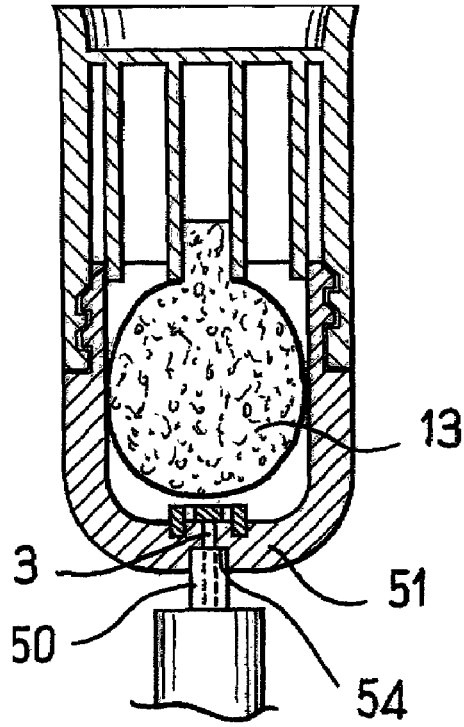
FIG. 9 is a cross-sectional view of another embodiment of a removable unit.

The removable unit 5 may be arranged for fixing directly on a hollow actuator rod 50 of a valve or a pump, for example, as shown in FIG. 9.

In this figure, the removable unit 5 may have a bottom portion defined by a transverse wall 51 defining the bottom of the inside space that receives the element 13. The wall 51 may be pierced by an orifice 53 provided with a shoulder 54 against which the rod 50 may abut.

In the example described, with reference to FIG. 3 and FIGS. 5 to 9, the application element 13 is secured to the top portion of the removable unit 5. Of course, it would not go beyond the ambit of the present invention for the refillable element 13 to be secured to the bottom portion of the removable unit 5.

Figure 10:
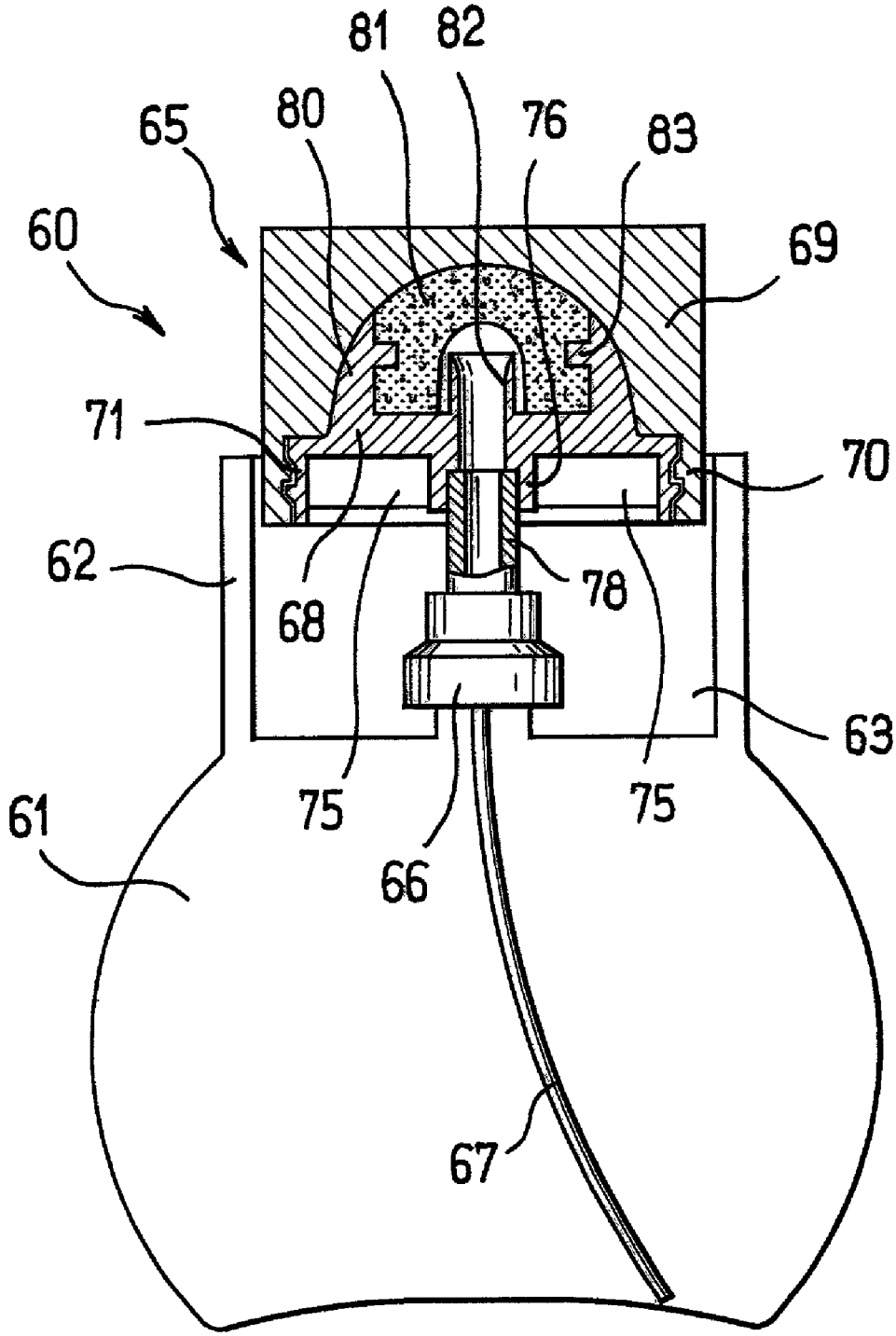
FIG. 10 is a partial cross-sectional view of another embodiment of a device according to the invention.

By way of example, FIG. 10 shows a device 60 comprising a receptacle 61 provided on top with a neck 62 defining a housing 63 for receiving a removable unit 65. The receptacle 61 may be fitted with a pump 66 provided with a dip tube 67 extending to the bottom of the receptacle. The pump 66 may include a hollow actuator rod 78 through which the product may be dispensed from the receptacle 2.

The removable unit 65 may comprise a bottom portion 68 and a top portion 69 which, in the example described, cooperate by screw fastening, for example. The top portion 69 may comprise an internally threaded outer skirt 70 that engages on the base of the bottom portion 68. To enable the top portion 69 to be unscrewed, holdable fins 75 may be formed around an endpiece 76 which may be used for connection with the actuator rod 78.

The bottom portion 68 may include a socket 80 for receiving an element 81 capable of absorbing the product, and for providing leakproofing between the bottom and top portions 68 and 69 when they are assembled together. The endpiece 76 may communicate with a central chimney 82 that opens out into the inside of the element 81, thus enabling it to be fed with product.

Relief portions 83 may be formed on the inside of the socket 80 in order to retain the porous element 81. In a variant, the porous element 81 may be retained by other suitable mechanisms, for example, by adhesive, by heat-sealing to the bottom portion 68, or the like.

In the closed state, the removable unit 65 can be used like a pushbutton for pushing down the actuator rod 78 so as to cause a quantity of product to be dispensed into the element 81.

In the example described, the element 81 may be constituted by a sintered element or a foam. The element 81 may have a shape such that it may be uncompressed by the top portion 69 when the top portion is in place on the bottom portion 68.

The inside section of the endpiece 76 may be selected in such a manner as to be small enough for the product that impregnates the element 81 to evaporate relatively slowly when the removable unit 65 is separated from the receptacle 61.

In a variant, a check valve, implemented in the form of a ball retained inside the chimney 82, for example, may be used for the purpose of closing the endpiece 76 whenever the removable unit 5 is separated from the receptacle 61.

In the example shown, the wall of the top portion 69 that comes into contact with the surface of the element 81 used for application purposes may itself be impermeable to the product that is filled into the applicator element 81. The product thus may remain substantially confined in the element 81. A relatively small quantity of product taken from the receptacle 2 may permit use of the removable unit 5 for a desirable length of time after having removed it from the receptacle 2.

Figure 12:
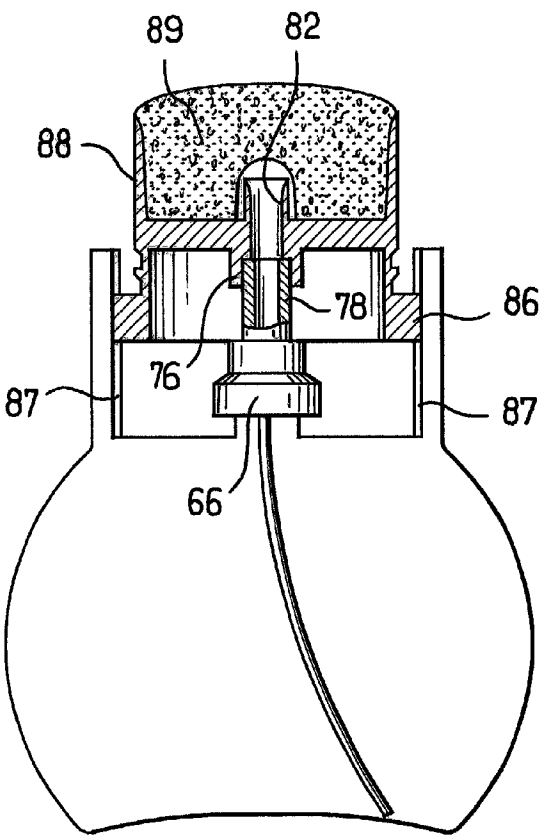
FIG. 12 shows the device of FIG. 11 with the removable unit ready for application.
Figure 11:
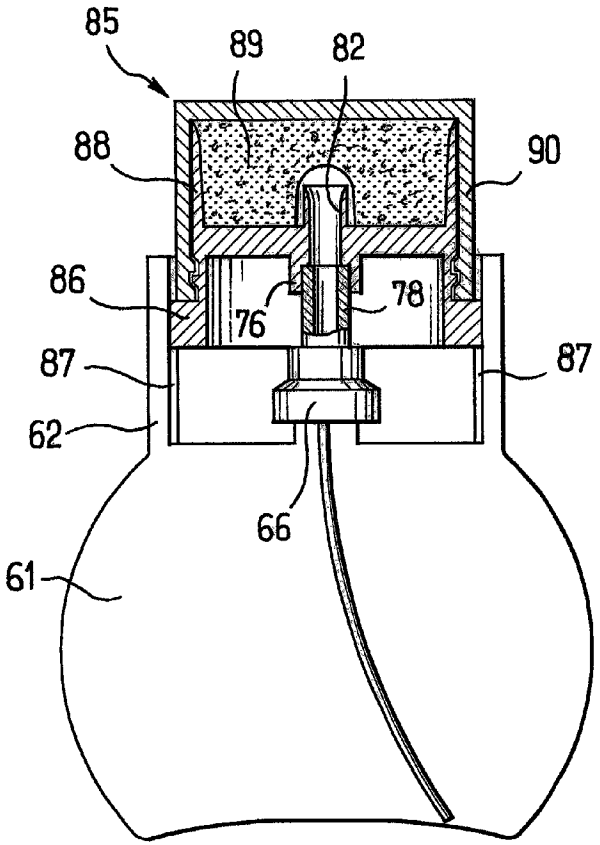
FIG. 11 is a partial cross-sectional view of yet another embodiment of a device according to the present invention.

FIGS. 11 and 12 show a removable unit 85 that has a bottom portion 86 designed to cooperate with splines 87 formed on the radially inside surface of the neck portion 62 of the receptacle 61. This may prevent the bottom portion 86 from rotating relative to the receptacle 61.

The bottom portion 86 may include a sealing skirt 88. The sealing skirt 88 may define a housing for an application element 89 that is suitable for being refilled.

Similar to the above-described removable unit 65, the removable unit 85 may have a chimney 82 feeding the element 89 and an endpiece 76 suitable for engaging on the actuator rod 78.

In this example, the element 89 may be constituted by a foam that may be compressed when the top portion 90 of the removable unit 85 is in place on the bottom portion 86. This foam may expand when the top portion 90 is removed, as can be seen in FIG. 12.

To refill the removable units 65 or 85, as described above, the user may utilize these removable units to push down the actuator rod 78 and cause a quantity of product to be dispensed so as to load the application element.

The wall of the top portion 90 that comes into contact with the element 89 may be impermeable to the substance contained in the receptacle.

Figure 22:
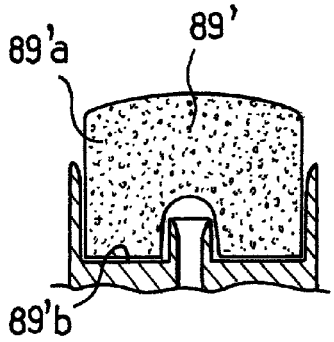
FIG. 22 is a view analogous to FIG. 12 showing another embodiment of a refillable element.

FIG. 22 shows another exemplary embodiment having an element 89' that differs from the element 89 in that it may not be fixed either to the skirt 88 or to the bottom portion 86, but instead may be freely positioned in the housing defined by the skirt 88. Further, the element 89' may emerge considerably from the housing when in an uncompressed state.

Thus, when the top portion 90 is removed, the element 89' expands and the top portion **89'*a* thereof may be used as a handle member. The user may hold the top portion 89'*a* to withdraw the element 89', and its bottom face 89'*a*** may then be used for applying product to a surface, such as skin, for example.

Figure 13:
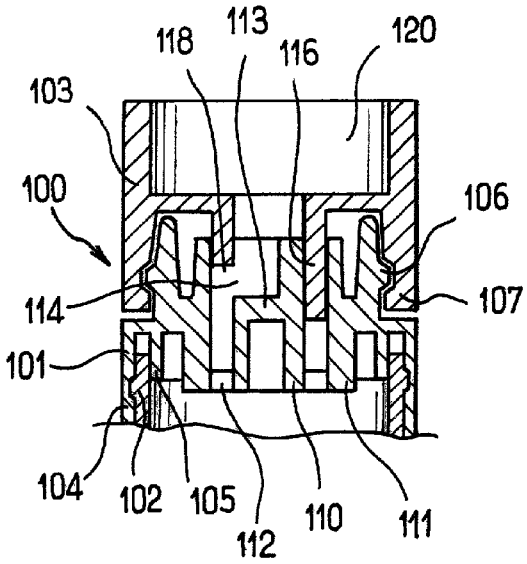
FIG. 13 is an axial section through a cock mounted on a receptacle.

When the receptacle does not have a pump or a valve, it may be provided with a cock 100, for example, as shown in FIG. 13. The cock 100 may comprise a bottom portion 101, for example, for fixing to the neck 102 of the receptacle and a top portion 103 capable of turning relative to the bottom portion 101 between a closed position and a dispensing position. The bottom portion 101 may comprise an assembly skirt 104 suitable for fixing to the neck 102, for example by screw fastening. A sealing lip 105 suitable for bearing in a substantially leakproof manner radially against the inside surface of the neck portion 102 also may be provided.

The bottom portion 101 also comprises an annular bearing surface 106 on which there may be engaged an outer skirt 107 of the top portion 103. The bottom portion 101 may further comprise two concentric tubular walls 110 and 111 interconnected by bridges of material 112. The inner tubular wall 110 may be closed substantially at half-height by a transverse wall 113 and may include a side opening 114 above the wall 113.

The top portion 103 may comprise a tubular wall 116 extending between the walls 110 and 111. This tubular wall 116 may define a side opening 118 capable of coinciding with the side opening 114 when the top portion 103 is in a dispensing position. Product may then flow between the walls 110 and 111, through the side openings 114 and 118, and into the inside of the tubular walls 110 and 116 above the wall 113.

When the top portion 103 is in a closed position, the tubular wall 116 may close the side opening 114 to close the receptacle. The top portion 103 may define a housing 120 suitable for receiving a removable unit in accordance with the invention.

Figure 14:
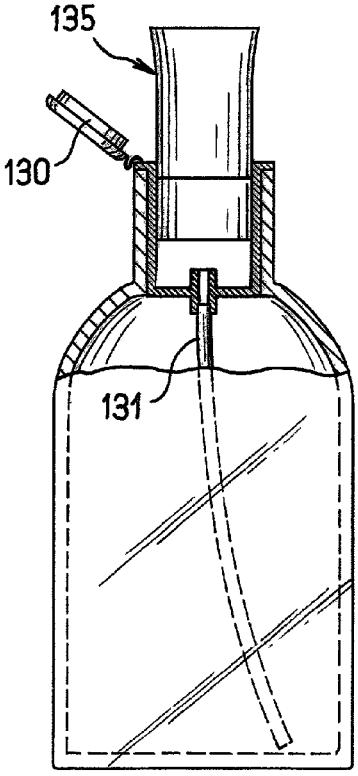
FIG. 14 is a partial cross-sectional view of another embodiment of a device according to the present invention.

Instead of using a cock 100 like that described with reference to FIG. 13, it may be possible to provide the receptacle with a lid 130, for example, as shown in FIG. 14. The lid 130 may be movable between an open position enabling a removable unit 135 to be inserted into the corresponding housing of the receptacle, and a closed position closing the housing substantially hermetically, in the absence of the removable unit.

The lid 130 may be secured to an insert 132 inserted in the neck portion of the receptacle.

FIG. 14 also shows that it is possible to cause the dispenser orifice through which substance is dispensed into the removable unit to communicate directly with a dip tube 131 extending to the bottom of the receptacle. The receptacle may be made with a wall that is compressible so as to enable the user to cause substance to rise into the removable unit 135 by pressing the wall.

Figure 19:
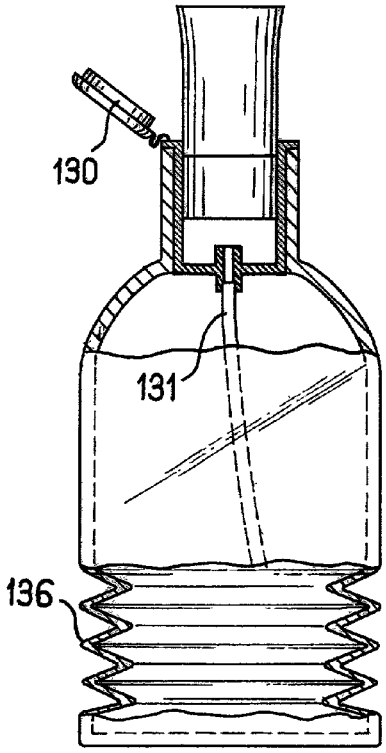
FIG. 19 is a view analogous to FIG. 14, with the receptacle including an embodiment of a bellows.

The receptacle shown in FIG. 19 differs from that shown in FIG. 14 in that it includes a bellows 136 suitable for varying the inside volume of the receptacle and for establishing pressure therein enabling the substance to be caused to rise up inside the dip tube.

The dip tube need not extend to the bottom of the receptacle, for example, when the bellows 136 is fully extended, and need only come close to the bottom of the receptacle when the bellows is compressed.

Figure 20:
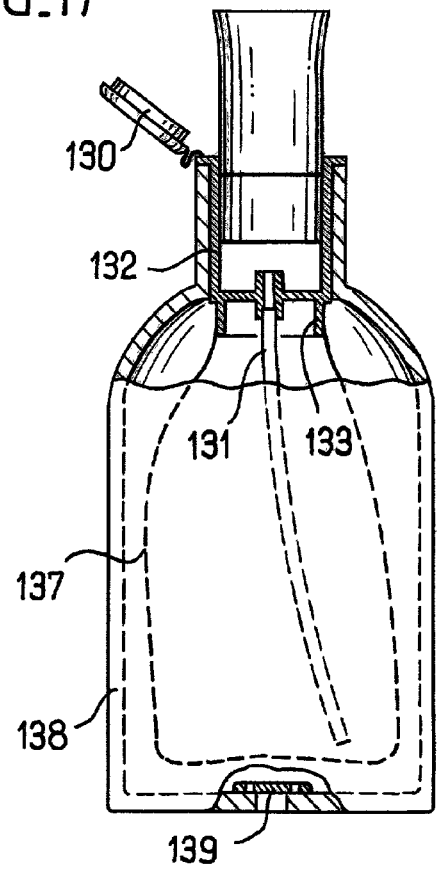
FIG. 20 is a view analogous to FIG. 14, with the receptacle housing an embodiment of a flexible bag containing the substance.

The receptacle shown in FIG. 20 differs from that described with reference to FIG. 14, in that it is configured to house a flexible bag 137 containing the substance.

The compressible case 138 of the receptacle enables air pressure to be increased around the bag 137 when pressure is applied thereto. This may enable product to rise up inside the tube 131.

To compensate for the vacuum created by emptying the bag, a check valve 139 may be provided.

This valve 139 may open when the pressure inside the case 138 is lower than the pressure outside the case 138. The bag 137 may be fixed on a skirt 133 formed integrally with the insert 132.

Figure 15:
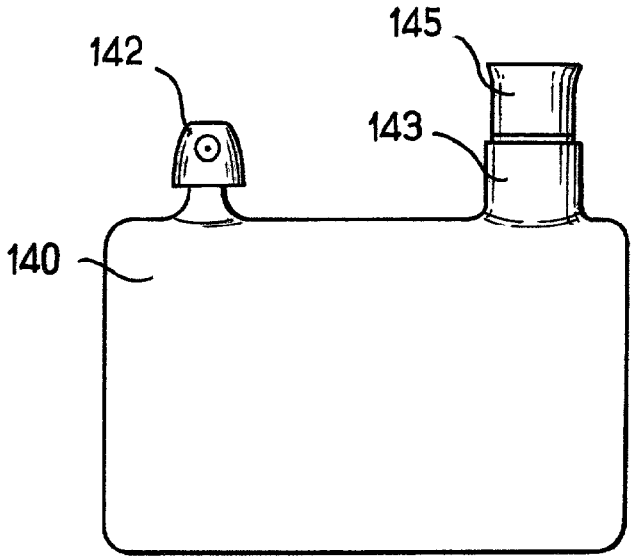
FIG. 15 is a perspective view of an embodiment of a receptacle provided with an actuator and a housing for receiving the removable unit.

As shown in FIG. 15, a receptacle 140 can be provided having both a pushbutton 142 and a neck 143 defining a housing suitable for receiving a removable unit 145. In the example of FIG. 15, the pushbutton 142 and the housing receiving the removable unit 145 are both mounted on the top of the receptacle.

Figure 16:
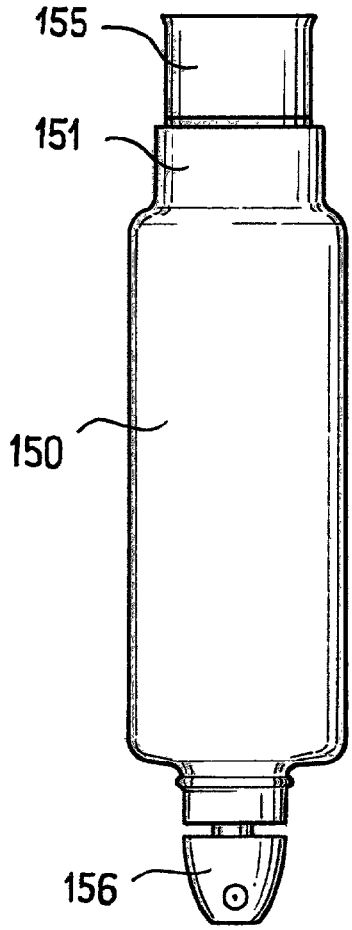
FIG. 16 is a perspective view of another embodiment of a receptacle provided with a pushbutton and with a housing for receiving the removable unit.

It is also considered within the scope of the invention for the pushbutton and the housing receiving the removable unit to be made at opposite axial ends of the receptacle, for example, as shown in FIG. 16. In this figure, a receptacle 150 provided at one end with a neck 151 defining a housing suitable for receiving a removable unit 155, and at its opposite end with a pushbutton 156.

In the embodiments described above, the removable unit includes an application element that may be used as an applicator at the time of use by being brought directly into contact with a surface, such as region of the body or of the face, for example.

Figure 17:
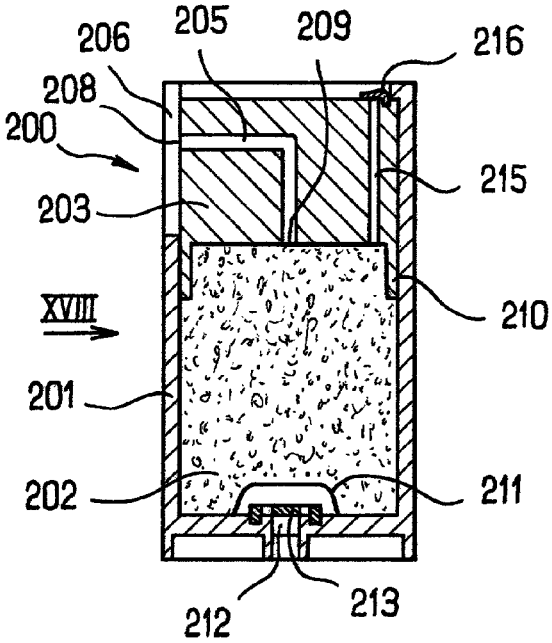
FIG. 17 is a cross-sectional view of an embodiment of a removable unit with a pushbutton according to the present invention.
Figure 18:
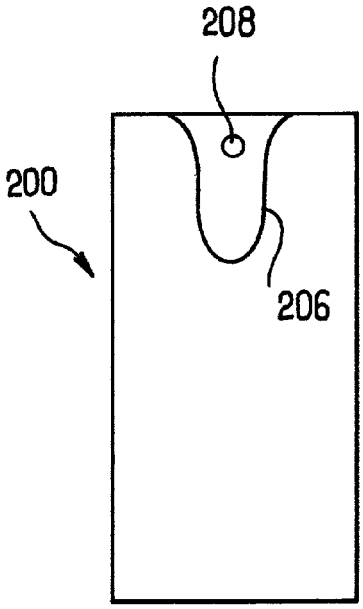
FIG. 18 is an elevation view looking along arrow XVIII of FIG. 17.

Alternatively, the element may serve merely as a reservoir for containing the substance, as described below with reference to the exemplary embodiment shown in FIGS. 17 and 18.

These figures show a removable unit 200 comprising a body 201 housing a compressible, porous element 202 in the form of an elastically deformable open-celled foam, for example. A pushbutton 203 capable of sliding inside the body 201 may compress the porous element 202.

The pushbutton 203 may have a channel 205 with one end 209 that opens towards the porous element 202 in order to receive the substance. The body 201 may have an opening 206 enabling the opposite end 208 of the channel 205 to open to the outside.

The pushbutton 203 may include a sealing lip 210 that may enable it to slide in leakproof manner inside the body 201. The pushbutton also may have a passage 215 that is closed at its top end by a microporous membrane 216 configured to allow air to flow slowly towards the outside. The passage 215 may allow residual air pressure to be eliminated. The microporous membrane 216 may be replaced by a micro-orifice, for example.

The body 201 may be provided at its bottom with an orifice 212 fitted with a check valve 213 similar to the check valve 40 described with reference to FIGS. 7 and 8. The element 202 may have a recess 211 over the check valve 213 so as to avoid impeding its operation.

The element 202 may be refilled with product in the same manner as the application elements of the removable units described above. When the user presses on the pushbutton 203, the loaded element 202 may be compressed so as to release product, which may then flow out via the channel 205.

Where appropriate, the orifice 208 may be provided with a nozzle so as to enable the substance to be dispensed in particulate manner, for example, in the form of a spray.

Figure 23:
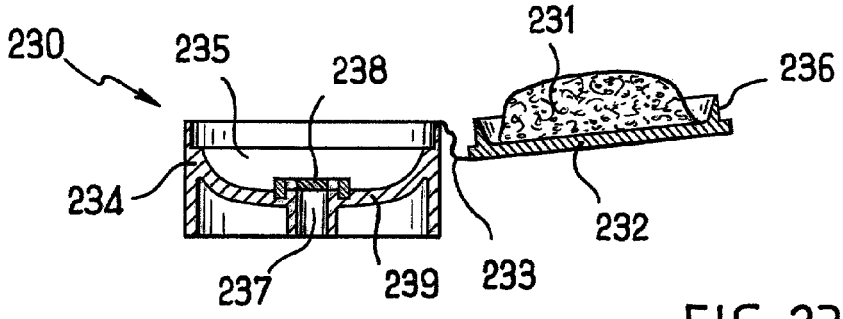
FIG. 23 is a cross-sectional view of yet another embodiment of a removable unit.

FIG. 23 shows an example of a removable unit 230 having a feature whereby it includes an application element 231 that is carried by an element 232 connected via a film hinge 233 to a body 234 of the removable unit. The body 234 defines a cavity 235, for example, a generally concave cavity. The cavity 235 may be configured for receiving the element 231 when the lid 232 is in place on the body 234 to close the cavity 235. By way of example, the lid 232 may include a sealing lip 236 suitable for pressing in leakproof manner against the body 234. The wall 239 defining the bottom of the cavity 235 may define an orifice 237. While the removable unit 230 is not being refilled with substance, the orifice 237 may be closed, for example, by a check valve 238.

The removable unit 230 may be used in a similar manner as the removable unit described with reference to FIG. 7. The lid 232 may be opened so as to allow the element 231 to be brought into contact with a surface on which the product is to be applied.

Figure 24:
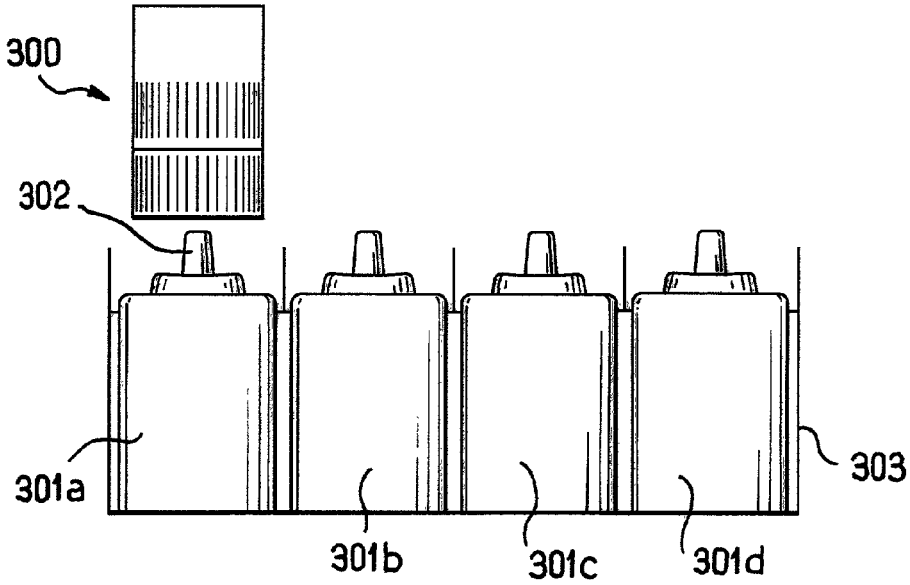
FIG. 24 is a perspective view of an embodiment of an application system having a removable unit and a plurality of receptacles.
Figure 25:
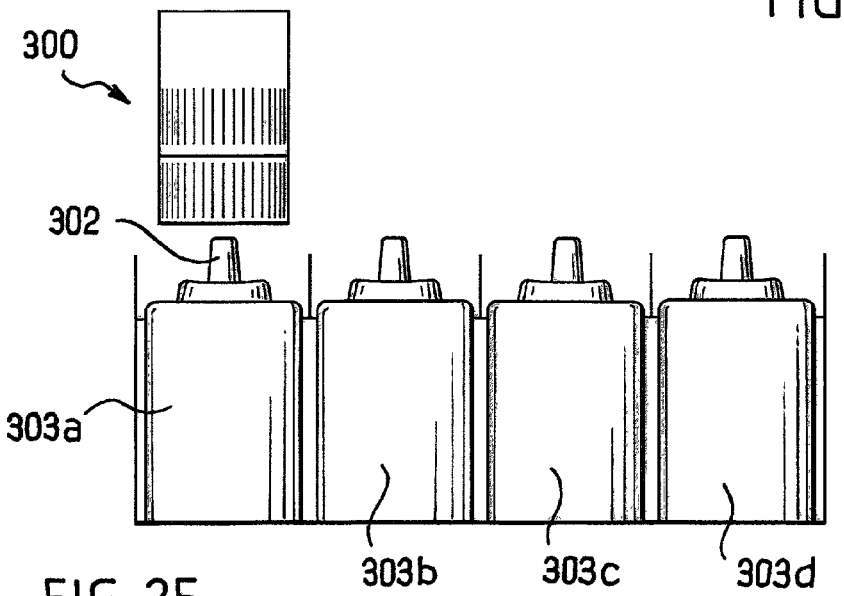
FIG. 25 is a perspective view of another embodiment of an application system having a removable unit and a plurality of receptacles.

As shown in FIGS. 24 and 25, it also may be possible to use a removable unit 300, such as one of the units described above, not merely with a single receptacle, but with a plurality of receptacles 301*a*, 301*b*, 301*c*, 301*d* (in an example where there are four such receptacles). Each of the plurality of receptacles may be provided with a respective pump 302, for example.

The removable unit 300 may be suitable for cooperating temporarily with any one of these receptacles in order to transfer a certain quantity of a product from the receptacle into the refillable element contained inside the removable unit.

Each of the receptacles 301*a*, . . . , 301*d* may thus contain, for example, a different product. For example, each may contain a perfume that corresponds to a particular scent, and the user can select a receptacle as a function of the scent the user desires to wear on any particular day. By way of example, the receptacle 301*a* can contain a given perfume while the receptacles 301*b* to 301*d* can contain amber, woody, or floral varieties of the perfume, respectively.

The user also may fill the removable unit with a plurality of different products by connecting the removable unit temporarily to a plurality of receptacles in succession, depending on which substances the user desires to transfer into the removable unit. The user may thus make up mixtures of scents, preparing a perfume "àla carte", as it were.

By way of example, the receptacles 301*a* to 301*d* can be contained in a single box 303, or they can be held on a common support, with the support being something other than a box.

The receptacles can contain substances other than perfumes. For example, they can contain creams, lotions, or other products for applying to skin, hair, fingernails, toenails, or other surfaces. Such products could be cosmetic products and/or treatment products. For example, the product could be in liquid form, cream form, or foam form.

The removable unit 300 can be associated, for example, with a receptacle 303*a* containing sunscreen, a receptacle 303*b* containing vitamin C, a receptacle 303*c* containing vitamin A, and a receptacle 303*d* containing salicylic acid, and naturally the number of receptacles is not limited to four and could be greater or smaller.

The invention is not limited to the exemplary embodiments described above. For example, the invention is not limited to storing and dispensing a perfume, but also may be used for other substances, such as cosmetics, dermatological or pharmaceutical products, for example for application to the hair, the skin, the mucous membranes, or the finger or toenails. Further, other types of products for application to surfaces may also be suited for use with the device of the present invention.

The removable unit and receptacle also may be given shapes and sizes other than those described above.

It will be apparent to those skilled in the art that various modifications and variations can be made to the structure and methodology. Thus, it should be understood that the invention is not limited to the examples discussed in the specification. Rather, the present invention is intended to cover modifications and variations.

What is claimed is:

1. A device for applying at least one product, the device comprising:

at least one receptacle configured to contain a product, the receptacle comprising a housing;

a cosmetic or care product contained in the at least one receptacle;

a removable unit defining a substantially enclosed space and not including a dip tube, at least part of the removable unit being configured to be removably received in the housing, the removable unit being configured to be removed from the housing while the unit defines the substantially enclosed space;

a first wall defining a bottom portion of the removable unit and a second wall extending across a neck of the receptacle housing; and at least one application element configured to be housed within the substantially enclosed space defined by the removable unit when the application element is not in use for applying product, the application element being further configured to be loaded with product from the receptacle when the removable unit is positioned on the receptacle, wherein the application element comprises at least one surface configured to apply the loaded product, the at least one surface facing the receptacle when the removable unit is positioned on the receptacle during loading of the application element with the product, wherein the bottom portion is located within the housing when the removable unit is positioned on the receptacle.

2. The device of claim 1, wherein at least a portion of the at least one application element is porous.

3. The device of claim 1, wherein the at least one application element is configured to hold a reserve of product.

4. The device of claim 1, wherein the removable unit comprises a first portion and second portion that are removably engageable with one another.

5. The device of claim 4, wherein the first portion and second portion are removably engageable by screw fastening.

6. The device of claim 4, wherein the first portion and second portion are engageable in a substantially leakproof manner.

7. The device of claim 6, wherein at least one of the first portion and the second portion includes a sealing member.

8. The device of claim 7, wherein the sealing member is chosen from a sealing skirt and a sealing gasket configured to press in a substantially leakproof manner against at least the other of the first portion and the second portion.

9. The device of claim 4, wherein the at least one application element is secured to one of the first portion and the second portion.

10. The device of claim 9, wherein the portion to which the at least one application element is secured is configured as a handle member configured to be held during application of the product.

11. The device of claim 9, wherein the portion to which the at least one application element is secured defines an orifice configured to permit flow of product therethrough for loading the at least one application element when the removable unit is positioned on the receptacle.

12. The device of claim 4, wherein the at least one application element is configured to be separated from the first and second portions during application of the product.

13. The device of claim 12, further comprising a handle member configured to be held during application of product via the at least one application element.

14. The device of claim 13, wherein the at least one application element comprises a portion forming the handle member.

15. The device of claim 14, wherein the portion forming a handle member is configured to be compressed when the first portion and the second portion are engaged with one another and to expand when the first portion and the second portion are removed from one another.

16. The device of claim 1, wherein the removable unit comprises an endpiece configured to cooperate with a portion of the receptacle.

17. The device of claim 16, wherein the endpiece is configured to cooperate with one of a valve, a pump, and a neck portion associated with the receptacle.

18. The device of claim 16, wherein the endpiece is configured to cooperate with one of a valve and a pump on the receptacle and wherein the removable unit is configured to move relative to the receptacle so as to actuate said one of the pump and the valve.

19. The device of claim 1, wherein the receptacle defines an orifice for flowing product into the removable unit when the removable unit is positioned on the receptacle, and wherein the device further comprises a sealing member configured to establish a substantially leakproof connection between the removable unit and the orifice.

20. The device of claim 1, wherein the removable unit further comprises a valve configured to open to permit an amount of product to flow from the receptacle into the removable unit while the removable unit is positioned on the receptacle.

21. The device of claim 20, wherein the valve is further configured to close at least when the removable unit is removed from the receptacle.

22. The device of claim 20, wherein the removable unit comprises a first portion and a second portion configured to be removably engaged with one another, and wherein the valve is one of overmolded and fixed by snap fastening on one of the first and second portions.

23. The device of claim 1, wherein the removable unit comprises a wall defining at least one orifice configured to flow product therethrough.

24. The device of claim 23, wherein the wall comprises the first wall.

25. The device of claim 23, further comprising a pad configured to be disposed between the at least one application element and the orifice when the removable unit is positioned on the receptacle.

26. The device of claim 25, wherein the pad is porous.

27. The device of claim 1, wherein the at least one application element is made of a non-compressible material.

28. The device of claim 27, wherein the application element is made of a sintered material.

29. The device of claim 27, wherein the application element is made of a material chosen from sintered polyethylene, PVC, EVA, polyamide, and brass.

30. The device of claim 1, wherein the at least one application element is made of a compressible material.

31. The device of claim 30, wherein the application element is made of an elastically deformable material.

32. The device of claim 30, wherein the application element is made of a material chosen from a foam of polyurethane, a foam of polyester, a foam of polyether, a foam of PVC, a foam of NBR, a felt, and a multilayer composite.

33. The device of claim 1, wherein at least part of the at least one application element is one of flocked, comprises a woven surface fabric, and comprises a non-woven surface fabric.

34. The device of claim 1, wherein the housing comprises a wall for guiding movement of the removable unit while it is placed in position on the receptacle.

35. The device of claim 1, further comprising one of a pump and a valve for dispensing product from the receptacle into the removable unit.

36. The device of claim 35, wherein the one of the pump and the valve is configured to be actuated by the removable unit.

37. The device of claim 1, wherein the receptacle defines an orifice configured to be in flow communication with the product in the receptacle.

38. The device of claim 37, further comprising a cock configured to substantially prevent flow communication through the orifice when the removable unit is removed from the receptacle.

39. The device of claim 1, the housing is provided with a lid configured to close the housing when the removable unit is removed from the receptacle.

40. The device of claim 39, wherein the lid is hingedly connected to the receptacle.

41. The device of claim 1, wherein the receptacle further comprises a dispensing member on a portion of the receptacle separate from a portion on which the removable unit is configured to be positioned, the dispensing member being configured to dispense product from the receptacle.

42. The device of claim 41, wherein the dispensing member is a pushbutton actuator.

43. The device of claim 41, wherein the dispensing mechanism is positioned on the same side of the receptacle as the removable unit.

44. The device of claim 43, wherein the dispensing mechanism and the removable unit are positioned on a top portion of the receptacle.

45. The device of claim 41, wherein the dispensing mechanism is positioned on a different side of the receptacle than the removable unit.

46. The device of claim 45, wherein the dispensing mechanism and the removable unit are positioned on substantially opposite sides of the receptacle.

47. The device of claim 45, wherein the dispensing mechanism and the removable unit are positioned substantially along a longitudinal axis of the receptacle.

48. The device of claim 41, wherein the dispensing mechanism is configured to dispense product from the receptacle independent from loading of the at least one application element with the product.

49. The device of claim 1, wherein the housing includes at least one relief portion for cooperating with the removable unit so as to substantially prevent rotation of the removable unit relative to the receptacle when the removable unit is positioned on the receptacle.

50. The device of claim 1, further comprising a dip tube configured to extend within the receptacle.

51. The device of claim 1, wherein the at least one application element occupies a portion of the space when the product is not loaded therein and is configured to expand within the space upon being loaded with product.

52. The device of claim 1, wherein the removable unit is configured to be placed in a closed position in which access to the space is substantially prevented and an open position in which access to the space is permitted.

53. The device of claim 52, wherein the at least one application element is configured to be compressed when the removable unit is in the closed position and to expand when the removable unit is in the open position.

54. The device of claim 53, wherein a portion of the application element forms a handle member upon expansion.

55. The device of claim 1, wherein the removable element further comprises a hinged lid portion, the at least one application element being attached to the hinged lid portion.

56. The device of claim 1, wherein the housing is configured to independently receive the removable unit and a removable dispensing mechanism for dispensing product from the receptacle.

57. The device of claim 56, further comprising the dispensing mechanism.

58. The device of claim 57, wherein the dispensing mechanism comprises a push-button actuator.

59. The device of claim 1, wherein the product is perfume.

60. The device of claim 1, wherein the product is configured to be applied to one of skin, hair, fingernails, and toenails.

61. The device of claim 1, wherein a length of the removable unit is less than a length of the receptacle.

62. The device of claim 1, wherein the application element is not immersed in product contained in the receptacle when the removable unit is received in the housing.

63. The device of claim 1, wherein the removable unit is separated from the product contained in the receptacle when the removable unit is received in the housing.

64. A device for applying at least one product, the device comprising:

a removable unit defining a substantially enclosed space and not including a dip tube, at least part of the removable unit being configured to be removably received in a housing of a receptacle containing a product, the removable unit being configured to be removed from the housing while the unit defines the substantially enclosed space; and at least one nonbristled application element configured to be received within the substantially enclosed space, the at least one application element being further configured to be loaded with product from the receptacle when the removable unit is positioned on the receptacle, wherein the at least one application element comprises at least one surface configured to apply the loaded product, the at least one surface facing the receptacle when the removable unit is positioned on the receptacle during loading of the at least one application element with product, and wherein the removable unit is separated from the product contained in the receptacle when the removable unit is received in the housing.

65. An application system comprising:

the device of claim 64; and at least two receptacles, each of the at least two receptacles comprising a housing in which said at least part of the removable unit is configured to be independently removably received.

66. The application system of claim 65, wherein the at least two receptacles are held by a common support or housed in a common box.

67. The application system of claim 65, wherein each of the at least two receptacles contains product differing from product contained in another of the at least two receptacles.

68. The device of claim 64, wherein at least part of the application element comprises flocking.

69. The device of claim 64, wherein the application element is configured to apply the product in the receptacle to one of skin, hair, fingernails, and toenails.

70. The device of claim 64, wherein the at least one application element is connected to a portion of the removable unit.

71. The device of claim 64, further comprising a valve configured to control product flow between the receptacle and the removable unit.

72. The device of claim 64, wherein the application element is not immersed in product contained in the receptacle when the removable unit is received in the housing.

73. The device of claim 64, wherein a length of the removable unit is less than a length of the receptacle.

74. A method of loading an application device, comprising: providing a removable unit defining a space and at least one application element configured to be received within the space;

selecting at least one receptacle from a plurality of receptacles containing differing products;

positioning the removable unit on the at least one selected receptacle; and flowing product from the at least one selected receptacle into the removable unit so as to load the at least one application element with at least the product from the at least one selected receptacle.

75. The method of claim 74, further comprising placing the at least one loaded application element in contact with a surface so as to apply the loaded product to the surface.

76. The method of claim 74, further comprising removing the removable unit from the selected receptacle after loading the at least one application element with the product.

77. The method of claim 76, further comprising carrying the removable unit away from the receptacle.

78. The method of claim 74, further comprising opening the removable unit so as to permit access to at least one surface of the application element configured for applying the loaded product.

79. The method of claim 74, wherein the selecting comprises selecting more than one receptacle from the plurality of receptacles containing differing products.

80. The method of claim 79, further comprising positioning the removable unit on each of the selected receptacles one at a time and flowing product from each of the selected receptacles into the removable unit.

81. The method of claim 80, further comprising placing the at least one application element into contact with a surface so as to apply the loaded product to the surface prior to positioning the removable unit on another of the selected receptacles and flowing the product from the other selected receptacle into the removable unit.

82. The method of claim 79, wherein the plurality of receptacles contain products having differing scents.

83. The method of claim 79, wherein at least one of the plurality of receptacles contains an active agent.

84. The method of claim 74, wherein the at least one application element comprises at least one surface configured to apply the loaded product, the at least one surface facing the receptacle when the removable unit is positioned on the receptacle during loading of the application element with product.

85. The method of claim 74, wherein the removable unit defines a substantially enclosed space.

86. The method of claim 74, wherein the removable element comprises a first portion configured to engage with a portion of the at least one selected receptacle and a second portion configured to cooperate with the first portion, and the at least one application element is secured to the second portion.

87. A method of loading an application device, comprising:

providing a device comprising:

a removable unit defining a substantially enclosed space and not including a dip tube, at least part of the removable unit being configured to be removably received in a housing of a receptacle containing a product, the removable unit being configured to be removed from the housing while the unit defines the substantially enclosed space; and at least one application element configured to be received within the substantially enclosed space, the at least one application element being further configured to be loaded with product from the receptacle when the removable unit is positioned on the receptacle, wherein the at least one application element comprises at least one surface configured to apply the loaded product, the at least one surface facing the receptacle when the removable unit is positioned on the receptacle during loading of the at least one application element with product;

selecting at least one receptacle from a plurality of receptacles containing differing products;

positioning the removable unit on the at least one selected receptacle; and flowing product from the at least one selected receptacle into the removable unit so as to load the at least one application element with at least the product from the at least one selected receptacle.

88. The method of claim 87, further comprising placing the at least one loaded application element in contact with a surface so as to apply the loaded product to the surface.

89. The method of claim 87, further comprising removing the removable unit from the selected receptacle after loading the at least one application element with the product.

90. The method of claim 89, further comprising carrying the removable unit away from the receptacle.

91. The method of claim 87, further comprising opening the removable unit so as to permit access to at least one surface of the application element configured for applying the loaded product.

92. The method of claim 91, further comprising positioning the removable unit on each of the selected receptacles one at a time and flowing product from each of the selected receptacles into the removable unit.

93. The method of claim 92, further comprising placing the at least one application element into contact with a surface so as to apply the loaded product to the surface prior to positioning the removable unit on another of the selected receptacles and flowing the product from the other selected receptacle into the removable unit.

94. The method of claim 87, wherein the selecting comprises selecting more than one receptacle from the plurality of receptacles containing differing products.

95. The method of claim 94, wherein the plurality of receptacles contain products having differing scents.

96. A device for applying a product, the device comprising:

a removable unit defining a substantially enclosed space and not including a dip tube, at least part of the removable unit being configured to be removably received in a housing of a receptacle containing a product, the removable unit comprising a first portion configured to removably engage with a the housing of the receptacle, and a second portion configured to cooperate with the first portion so as to place the removable unit in one of a closed position so as to substantially restrict access to the space and an open position so as to permit access to the space, the first portion being configured to be removed from the housing together with the second portion in the closed position; and at least one application element configured to be received in the substantially enclosed space when the application element is not in use for applying product, wherein the at least one application element is secured to the second portion or separated from the first portion and the second portion, wherein the device further comprises a cosmetic or care product to be applied using the at least one application element, and wherein the removable unit is separated from the product contained in the receptacle when the removable unit is received in the housing.

97. The device of claim 96, wherein the first portion and the second portion are configured to be separated from one another when the removable unit is in the open position.

98. The device of claim 96, wherein at least a portion of the at least one application element is porous.

99. The device of claim 96, wherein the at least one application element is configured to hold a reserve of product.

100. The device of claim 96, wherein the first portion and the second portion are removably engageable with one another via one of screw-fastening and snap-fastening.

101. The device of claim 96, wherein the first portion and the second portion are configured to cooperate with one another in a substantially leakproof manner when the removable unit is in the closed position.

102. The device of claim 101, wherein at least one of the first and second portions includes one of a sealing skirt and a sealing gasket configured to press in a substantially leakproof manner against at least the other of the first portion and the second portion.

103. The device of claim 96, wherein the application element is secured to the second portion.

104. The device of claim 103, wherein the second portion is configured as a handle member configured to be held during application of the product via the at least one application element.

105. The device of claim 103, wherein the second portion is hingedly connected to the first portion.

106. The device of claim 103, wherein the second portion is configured to be separated from the first portion.

107. The device of claim 103, wherein the first portion defines an orifice configured to permit flow of product for loading the at least one application element when the removable unit is received in the housing.

108. The device of claim 96, wherein the at least one application element is separated from the first and second portions.

109. The device of claim 108, further comprising a handle member configured to be held during application of product via the at least one application element.

110. The device of claim 108, wherein the at least one application element comprises a portion forming the handle member.

111. The device of claim 110, wherein the portion forming the handle member is configured to be compressed when the removable unit is in the closed position and to be uncompressed when the removable unit is in the open position.

112. The device of claim 96, wherein the removable unit comprises an endpiece configured to cooperate with a portion of the receptacle.

113. The device of claim 112, wherein the endpiece is configured to cooperate with one of a valve, a pump, and a neck portion associated with the receptacle.

114. The device of claim 112, wherein the endpiece is configured to cooperate with one of a valve and a pump associated with the receptacle, and wherein the removable unit is configured to move relative to the receptacle so as to actuate one of the pump and the valve.

115. The device of claim 96, wherein the receptacle defines an orifice for flowing product into the removable unit, and wherein the device further comprises a sealing member configured to establish a substantially leakproof connection between the removable unit and the orifice.

116. The device of claim 96, wherein the removable unit further comprises a valve configured to open to permit an amount of product to flow from the receptacle into the removable unit while said at least part of the removable unit is received in the housing.

117. The device of claim 116, wherein the valve is further configured to close at least when said at least part of the removable unit is removed from the housing.

118. The device of claim 116, wherein the valve is one of overmolded and fixed by snap fastening on the first portion of the removable unit.

119. The device of claim 96, wherein the first portion of the removable unit comprises a wall defining at least one orifice configured to flow product therethrough.

120. The device of claim 119, wherein the wall defines a bottom of the space when said at least part of the removable unit is received in the housing.

121. The device of claim 120, further comprising a pad configured to be disposed between the at least one application element and the orifice when said at least part of the removable unit is received in the housing.

122. The device of claim 121, wherein the pad is porous.

123. The device of claim 96, wherein the at least one application element is made of a non-compressible material.

124. The device of claim 123, wherein the application element is made of a sintered material.

125. The device of claim 123, wherein the application element is made of a material chosen from sintered polyethylene, PVC, EVA, polyamide, and brass.

126. The device of claim 96, wherein the at least one application element is made of a compressible material.

127. The device of claim 126, wherein the at least one application element is made of an elastically deformable material.

128. The device of claim 127, wherein the at least one application element is made of a material chosen from a foam of polyurethane, a foam of polyester, a foam of polyether, a foam of PVC, a foam of NBR, a felt, and a multilayer composite.

129. The device of claim 96, wherein at least part of the at least one application element is one of flocked, comprises a woven surface fabric, and comprises a non-woven surface fabric.

130. The device of claim 96, wherein the at least one application element occupies a portion of the space when the product is not loaded therein and is configured to expand within the space upon being loaded with product.

131. An application system comprising:

the device of claim 96; and at least one receptacle comprising a housing in which said at least part of the removable unit is configured to be removably received, the at least one receptacle being configured to contain a product to be applied.

132. The system of claim 131, wherein the at least one receptacle comprises a plurality of receptacles configured to contain different products.

133. The system of claim 132, wherein the plurality of receptacles are one of held by a common support and housed in a common box.

134. The application system of claim 131, wherein each of the at least two receptacles contains product differing from product contained in another of the at least two receptacles.

135. The device of claim 96, wherein the product is configured to be applied to one of skin, hair, fingernails, and toenails.

136. A device for applying a product, the device comprising:

a receptacle:

a removable unit defining a substantially enclosed space and being configured to be removably positioned on the receptacle, the removable unit comprising a first portion configured to removably engage with a portion of the receptacle, and a second portion configured to cooperate with the first portion so as to place the removable unit in one of a closed position so as to substantially restrict access to the space and an open position so as to permit access to the space; and at least one application element configured to be received in the substantially enclosed space when the application element is not in use for applying product, wherein the at least one application element is secured to the second portion or separated from the first portion and the second portion, wherein the device further comprises a cosmetic or care product to be applied using the at least one application element, wherein the receptacle includes a dispensing member on a portion of the receptacle separate from a portion on which the removable unit is configured to be positioned, and wherein when the removable unit is positioned on the portion of the receptacle on which the removable unit is configured to be positioned, the dispensing member is capable of dispensing product without loading the removable unit.

137. A method of loading an application device, comprising:

providing a device comprising:

a removable unit defining a substantially enclosed space and not including a dip tube, at least part of the removable unit being configured to be removably received in a housing of a receptacle containing a product, the removable unit comprising a first portion configured to removably engage with the housing of the receptacle, and a second portion configured to cooperate with the first portion so as to place the removable unit in one of a closed position so as to substantially restrict access to the space and an open position so as to permit access to the space, the first portion being configured to be removed from the housing together with the second portion in the closed position; and at least one application element configured to be received in the substantially enclosed space when the application element is not in use for applying product, wherein the at least one application element is secured to the second portion or separated from the first portion and the second portion, wherein the device further comprises a cosmetic or care product to be applied using the at least one application element;

selecting at least one receptacle from a plurality of receptacles containing differing products;

positioning the removable unit on the at least one selected receptacle; and flowing product from the at least one selected receptacle into the removable unit so as to load the at least one application element with at least the product from the at least one selected receptacle.

138. The method of claim 137, further comprising placing the at least one loaded application element in contact with a surface so as to apply the loaded product to the surface.

139. The method of claim 137, further comprising removing the removable unit from the selected receptacle after loading the at least one application element with the product.

140. The method of claim 139, further comprising carrying the removable unit away from the receptacle.

141. The method of claim 137, further comprising opening the removable unit so as to permit access to at least one surface of the application element configured for applying the loaded product.

142. The method of claim 137, wherein the selecting comprises selecting more than one receptacle from the plurality of receptacles containing differing products.

143. The method of claim 142, further comprising positioning the removable unit on each of the selected receptacles one at a time and flowing product from each of the selected receptacles into the removable unit.

144. The method of claim 143, further comprising placing the at least one application element into contact with a surface so as to apply the loaded product to the surface prior to positioning the removable unit on another of the selected receptacles and flowing the product from the other selected receptacle into the removable unit.

145. The method of claim 142, wherein the plurality of receptacles contain products having differing scents.

146. A device for applying at least one product, the device comprising:

a removable unit defining a substantially enclosed space and being rigid such that the substantially enclosed space does not have a variable volume, the removable unit being configured to be removably positioned on a receptacle containing a product and being configured to be removed from the receptacle while the unit defines the substantially enclosed space; and at least one nonbristled application element configured to be received within the substantially enclosed space, the at least one application element being further configured to be loaded with product from the receptacle when the removable unit is positioned on the receptacle, wherein the at least one application element comprises at least one surface configured to apply the loaded product, and wherein the removable unit is separated from the product contained in the receptacle when the removable unit is received in the housing.

147. The device of claim 146, wherein at least part of the application element comprises flocking.

148. The device of claim 146, further comprising a valve configured to control product flow between the receptacle and the removable unit.

149. The device of claim 146, wherein the application element is not immersed in product contained in the receptacle when the removable unit is received in the housing.

150. The device of claim 146, wherein the application element is configured to apply product from the receptacle to one of skin, hair, fingernails, and toenails.

151. A device for applying at least one product, the device comprising:

a removable unit comprising a first portion and a second portion configured to be releasably connected together to define a substantially enclosed space, the removable unit being configured to be removably positioned on at least one receptacle containing a product, the removable unit being configured to be removed from the receptacle while the unit defines the substantially enclosed space; and at least one nonbristled application element configured to be housed within the substantially enclosed space defined by the removable unit when the application element is not in use for applying product, the application element being further configured to be loaded with product from the receptacle when the removable unit is positioned on the receptacle, wherein the application element comprises at least one surface configured to apply the loaded product, and wherein the removable unit is separated from the product contained in the receptacle when the removable unit is received in the housing.

152. The device of claim 151, wherein a length of the removable unit is less than a length of the receptacle.

153. The device of claim 151, wherein the application element is configured to apply product from the receptacle to one of skin, hair, fingernails, and toenails.

154. The device of claim 151, wherein the at least one application element is connected to a portion of the removable unit.

155. The device of claim 151, further comprising a valve configured to control product flow between the receptacle and the removable unit.

156. The device of claim 151, wherein the application element is not immersed in product contained in the receptacle when the removable unit is received in the housing.

157. The device of claim 151, further comprising a first wall defining a bottom portion of the removable unit and a second wall extending across a neck of the receptacle housing.

158. The device of claim 151, wherein at least part of the application element comprises flocking.

159. A device for applying at least one product, the device comprising:

at least one receptacle configured to contain a product, the receptacle comprising a housing;

a cosmetic or care product contained in the at least one receptacle;

a removable unit defining a substantially enclosed space and not including a dip tube, at least part of the removable unit being configured to be removably received in the housing, the removable unit being configured to be removed from the housing while the unit defines the substantially enclosed space;

at least one application element configured to be housed within the substantially enclosed space defined by the removable unit when the application element is not in use for applying product, the application element being further configured to be loaded with product from the receptacle when the removable unit is positioned on the receptacle; and a valve configured to control product flow between the receptacle and the removable unit, wherein the application element comprises at least one surface configured to apply the loaded product, the at least one surface facing the receptacle when the removable unit is positioned on the receptacle during loading of the application element with the product.

* * * * *